US012414657B2

(12) United States Patent
Zimmerman et al.

(10) Patent No.: US 12,414,657 B2
(45) Date of Patent: Sep. 16, 2025

(54) DISPENSER FOR DISPENSING SHEET MATERIALS

(71) Applicants: Kimberly-Clark Worldwide, Inc., Neenah, WI (US); Ricardo Schwab Schirmer, Neenah, WI (US); Victor Credico Vida, Neenah, WI (US)

(72) Inventors: Maria Fernanda Zimmerman, Sao Paulo (BR); Vinicius Tortoza, Sao Paulo (BR); Ricardo Schwab Schirmer, Sao Paulo (BR); Victor Credico Vida, Sao Paulo (BR)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 18/550,991

(22) PCT Filed: Apr. 30, 2021

(86) PCT No.: PCT/US2021/030119

§ 371 (c)(1),
(2) Date: Sep. 18, 2023

(87) PCT Pub. No.: WO2022/231615

PCT Pub. Date: Nov. 3, 2022

(65) Prior Publication Data

US 2024/0156308 A1 May 16, 2024

(51) Int. Cl.
*A47K 10/32* (2006.01)

(52) U.S. Cl.
CPC ..... *A47K 10/32* (2013.01); *A47K 2010/3233* (2013.01); *A47K 2010/3266* (2013.01)

(58) Field of Classification Search
CPC ..... A47K 10/32
USPC ..... 221/33–63
See application file for complete search history.

(56) References Cited

U.S. PATENT DOCUMENTS

| | | | | |
|---|---|---|---|---|
| 7,147,129 | B1 * | 12/2006 | Menefield | A61F 6/005 206/440 |
| 7,726,513 | B2 * | 6/2010 | Schlaupitz | A47K 10/421 221/45 |
| 8,550,296 | B2 * | 10/2013 | Gerschwiler Steck | A47K 10/42 221/34 |
| 11,627,846 | B2 * | 4/2023 | Nielsen | A47K 10/424 221/45 |
| 2005/0035141 | A1 | 2/2005 | Haddad et al. | |
| 2008/0067185 | A1 | 3/2008 | Schlaupitz et al. | |
| 2014/0124525 | A1 * | 5/2014 | Delaney | A47K 10/38 221/34 |
| 2015/0035141 | A1 | 2/2015 | Kim et al. | |

(Continued)

OTHER PUBLICATIONS

International Search Report and Written Opinion for PCT/US2021/030119 dated Aug. 13, 2021, 10 pages.

*Primary Examiner* — Gene O Crawford
*Assistant Examiner* — Ayodeji T Ojofeitimi
(74) *Attorney, Agent, or Firm* — Dority & Manning, P.A.

(57) ABSTRACT

A dispenser is disclosed for holding and dispensing a package containing a wiping product, such as flushable premoistened wipes. The dispenser can be made from a single piece blank. The dispenser can include arms for engaging a rolled bathroom tissue fixture and can include an open end for receiving a package of wiping products and mating with the package in a way that facilitates dispensing of the product.

20 Claims, 5 Drawing Sheets

(56) References Cited

U.S. PATENT DOCUMENTS

| | | | | |
|---|---|---|---|---|
| 2015/0083743 | A1* | 3/2015 | D'Angelo | A47K 10/38 221/45 |
| 2015/0102050 | A1* | 4/2015 | Marin-Quintero | B65D 75/5838 221/63 |
| 2015/0374182 | A1* | 12/2015 | Delaney | A47K 10/426 221/45 |
| 2023/0233038 | A1* | 7/2023 | Sutterer | A47K 10/424 221/33 |

* cited by examiner

DISPENSER FOR DISPENSING SHEET MATERIALS

RELATED APPLICATIONS

The present application is the national stage entry of International Patent Application No. PCT/US2021/030119 having a filing date of Apr. 30, 2021, which is incorporated herein in their entirety by reference thereto.

BACKGROUND

Disposable premoistened wipes are marketed and sold in a variety of different forms. The premoistened wipes generally include a substrate that is saturated with a cleaning or wiping solution. The wiping solution applied to the substrate can vary depending upon the particular application. For instance, the wiping solution can contain an antimicrobial agent, a cleansing agent, a deodorant, a medicament, or the like. The substrate can comprise a nonwoven web containing polymeric fibers, pulp fibers, or a mixture of both. Many premoistened wipes are designed to degrade and disperse in water.

Premoistened wipes are generally packaged and sold to consumers as a stack of single sheets. Premoistened wipes are packaged and sold in various different types of containers. Premoistened bath tissues, for instance, are typically packaged in flexible and liquid-impermeable containers. The packages typically include a resealable opening for dispensing the wipes one at a time without causing the remaining wipes to undergo a loss of moisture. Although these packages are portable and can be carried anywhere, the packages are not well suited for being placed or displayed in a bathroom.

In the past, various other container designs for premoistened wipes have been proposed that can be attached to or hang from a rolled bath tissue dispenser. For example, U.S. Pat. No. 6,997,342, which is incorporated by reference, discloses a dispenser that includes arms which permit a housing to be coupled to a rolled product fixture. The dispenser is particularly designed to dispense individual sheets from a tabletop or from a rolled product fixture as described above.

Although various container designs have been proposed in the past for dispensing premoistened wipes from a rolled bathroom tissue dispenser, various improvements are still needed. In particular, a need exists for a dispenser for dispensing sheet materials from a rolled product fixture that can easily accommodate and hold packages of wipers, such as premoistened wipes. A need also exists for a collapsible dispenser as described above that can be provided to consumers in combination with a package of premoistened wipes and that is easy to assemble and install.

SUMMARY

In general, the present disclosure is directed to a collapsible dispenser for dispensing sheet materials from a rolled product fixture. The dispenser can be made from a single sheet of material that can be easily assembled into a housing for receiving a package of sheet materials, such as premoistened wipes. In one aspect, the dispenser is also foldable. When in the folded configuration, for instance, the dispenser can have a length and width that generally matches the length and width of the package of sheet material that the housing is adapted to hold.

In one embodiment, for example, the dispenser comprises a housing having a top defining a cutout portion, a bottom, and an enclosed first end. The dispenser can also include first and second opposing side walls that are positioned between the top and the bottom. The dispenser can further comprise first and second arms. Each arm extends from a corresponding side wall. Each arm is configured to engage a rolled product fixture. The dispenser further includes an open second end for receiving a package containing a sheet of wiping products and wherein the cutout portion of the top is positioned and has a size that corresponds to a dispensing opening on a package loaded into the dispenser.

As described above, the dispenser can be formed from a single blank of material. The material can be a paperboard or can be made from a polymer material. The single blank can include a plurality of fold lines that are positioned to facilitate assembly of the blank into the housing.

In order to engage a rolled product fixture, the first arm can define a first opening and the second arm can define a second opening. The first opening can be located at a first end portion of the first arm while the second opening can be located at a second end portion of the second arm. The first and second end portions are where the first and second arms terminate at their maximum extended position away from the housing. The first arm can be parallel to the second arm in a length direction and the first opening can be in alignment with the second opening in a direction perpendicular to the length direction. The first and second arms can be relatively straight or, alternatively, can have an angled portion that angles away from the housing.

In one embodiment, the first opening can define a first recess portion while the second opening can define a second recess portion. Each recess portion can be directed or pointed towards a terminal end of each arm. In one aspect, the first and second recess portions can be at an angle to the length direction of each side wall. The angle can be, for instance, from about 20° to about 50°. In one embodiment, the first opening and the second opening have a teardrop shape. The above configuration can allow the housing extending from the arms to not lay flat against an adjacent wall but instead assume an upright position that facilitates the dispensing of the premoistened wipes.

As described above, the housing has an open second end for receiving a package containing a stack of wiping products. The top can have a length that is shorter than the length of the package. In this manner, a portion of the package can remain exposed when inserted into the housing. The cutout portion on the top can define an open end and can have a shape that is configured to only partially surround a dispenser opening on a package loaded into the housing. For instance, the cutout portion can surround greater than about 20%, such as greater than about 30%, such as greater than about 40% of the dispenser opening, and generally less than about 80%, such as less than about 70%, such as less than about 60% of the perimeter of the dispenser opening. For example, the cutout portion can be in the shape of a partial oval or in the shape of a partial rectangle.

In one aspect, the bottom of the housing can include a first tab that engages the first side wall and a second tab that engages the second side wall. Each side wall can define a plurality of slots for receiving the tabs. For example, the plurality of slots can be positioned along the width of each side wall and wherein a depth of the housing can be adjusted by selecting one of the slots. For example, the first and second tabs can be inserted into one of the corresponding plurality of slots on each side wall. In this manner, the depth of the housing can be adjusted as the wiping product is dispensed and depleted.

In one aspect, the dispenser of the present disclosure is collapsible. For example, the dispenser can assume a folded configuration that is similar in size to a package designed to be received within the housing. In a folded configuration, for instance, the bottom, the enclosed first end, and the side walls all can be folded onto the top. In addition, the arms can be folded onto the side walls. In this manner, the folded configuration of the housing generally has a rectangular shape and protects the arms from damage.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which.

Figure 1:
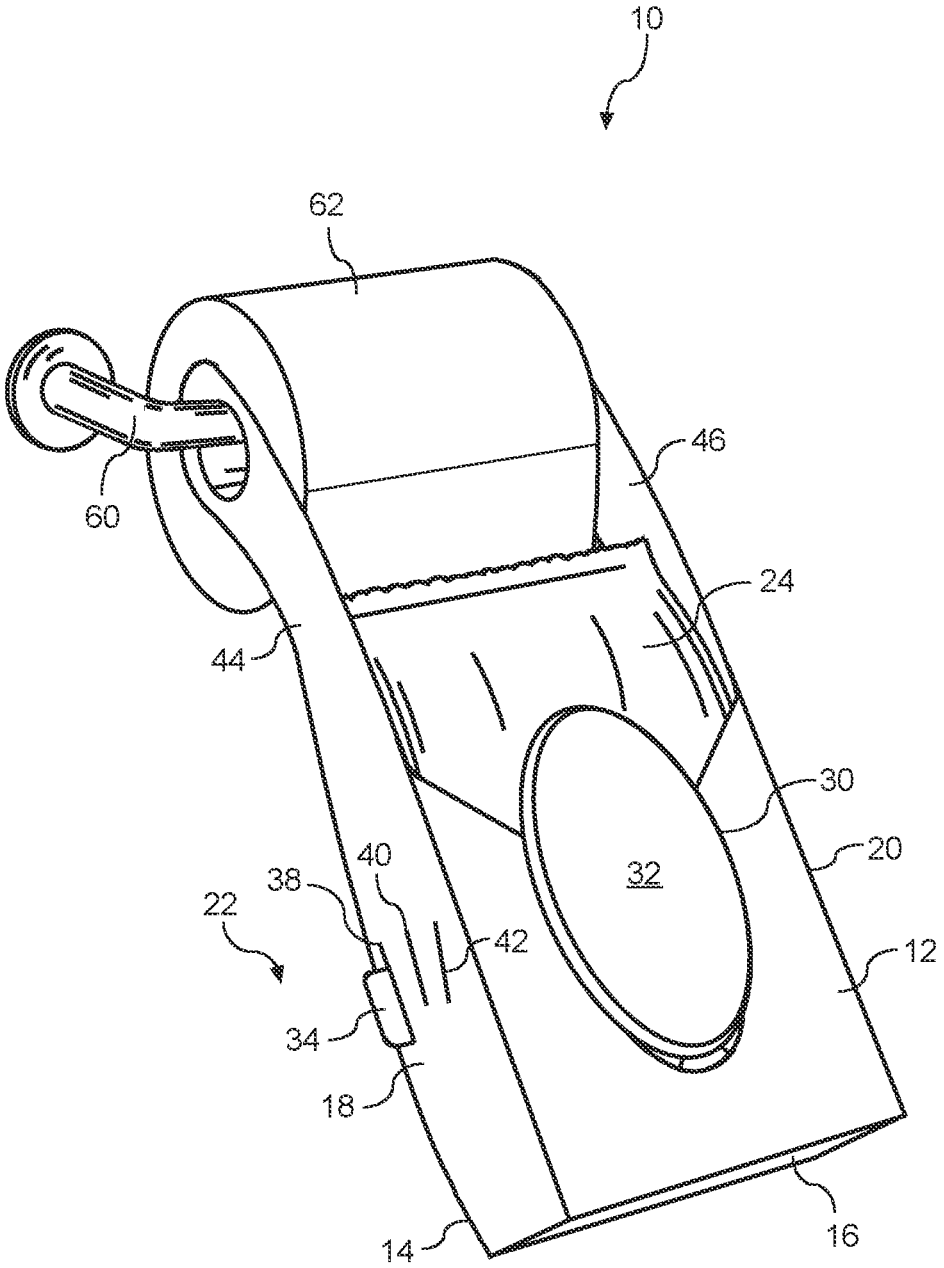
FIG. 1 is a perspective view of one embodiment of a dispenser for dispensing sheet materials from a rolled product fixture in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a dispenser that is designed to receive a package containing a wiping product for dispensing the wiping product. In accordance with the present disclosure, the dispenser is configured to engage and hang from an adjacent structure for facilitating dispensing of the wiping product. Although the dispenser can be designed to engage any suitable mountable device, in one aspect, the dispenser is particularly well suited for engaging and being attached to a rolled product fixture, such as a bath tissue dispenser. For example, the dispenser can include arms that are designed to engage and extend from a spindle that holds a rolled bath tissue. The arms have a length sufficient so as not to interfere with the unwinding of the bath tissue. The arms, however, also have a configuration that allows for a user to easily remove wiping products from the dispenser. For example, in one embodiment, the wiping product that is held within the dispenser can be a water dispersible and/or flushable product that may comprise, for instance, a premoistened bath tissue.

As will be explained in greater detail below, the dispenser of the present disclosure has a relatively simple design and can be constructed from a one-piece blank. The blank can include fold lines for easily assembling the blank into the dispenser. In a folded configuration, the dispenser can have a length and width that substantially matches the length and width of a package designed to be held by the dispenser. In this way, the dispenser can be marketed with the package and used by the consumer when desired.

Figure 2:
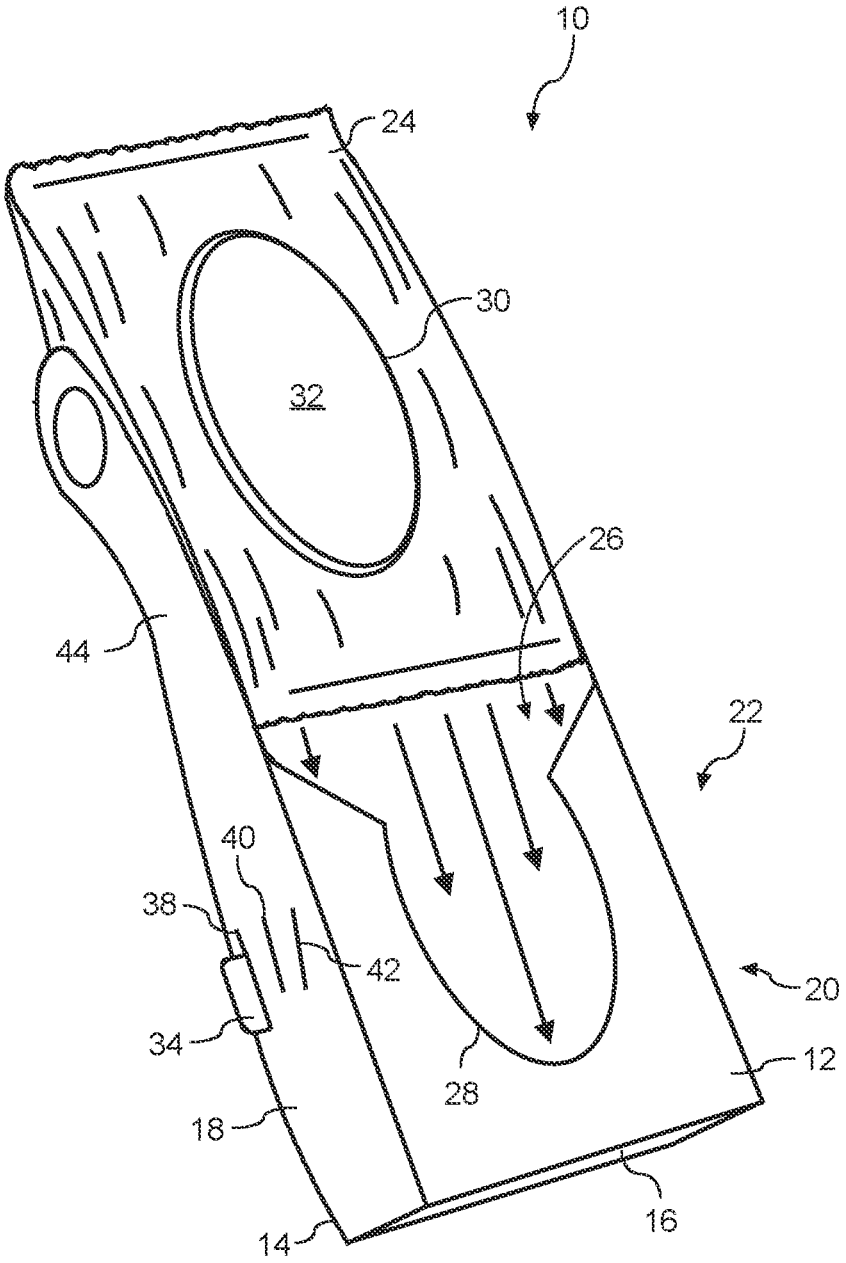
FIG. 2 is a perspective view of the dispenser illustrated in FIG. 1 showing a package of sheet material being loaded into the dispenser.

Referring to FIGS. 1 and 2, for example, one embodiment of a dispenser 10 made in accordance with the present disclosure is shown. The dispenser 10 includes a top 12 opposite a bottom 14. The dispenser 10 can also include an enclosed first end 16. The dispenser 10 further includes a first side wall 18 opposite a second side wall 20. The first and second side walls are positioned between the top 12 and the bottom 14. In the embodiment illustrated, the first and second side walls 18 and 20 are integral with the top 12 but separate from the bottom 14. The top 12, bottom 14, enclosed first end 16, and first and second side walls 18 and 20, when in an assembled configuration, define a housing 22. The housing 22 defines an interior volume that is designed to receive a package 24 containing sheets of a wiping product. For example, FIG. 2 illustrates the package 24 being loaded into the housing 22. As shown, the housing 22 can include an open end 26 for receiving the package 24.

In the embodiment illustrated in FIG. 1, the top 12 has a length that only partially covers the package 24. In this manner, as shown in FIG. 1, a portion of the package 24 remains visible when loaded into the housing 22. The top 12 can include a cutout portion 28. The cutout portion 28 is positioned and has a size that corresponds to a dispenser opening 30 on the package 24. As shown in the embodiment illustrated in FIGS. 1 and 2, the package 24 includes a lid 32 that covers the opening 30. The lid 32, for instance, can be designed to be reclosable after a wiping product has been dispensed from the package 26. The lid 32 not only protects the wiping products within the package but also prevents the package from drying out after being opened.

The cutout portion 28 of the top 12 as shown in the embodiment of FIGS. 1 and 2 can partially surround the opening 30 of the package 26. For example, the opening 30 can have a perimeter or circumference and the cutout portion 28 can surround greater than about 30%, such as greater than about 40%, such as greater than about 50%, such as greater than about 60%, and generally less than about 80%, such as less than about 70%, such as less than about 65% of the length of the perimeter or circumference. In this manner, the housing 22 conveniently mates with the opening 30 on the package 24 while still permitting the package 24 to be easily inserted and removed from the housing 22.

In the embodiment illustrated in FIGS. 1 and 2, the cutout portion 28 includes an open end. In an alternative embodiment, however, the cutout portion 28 may be completely enclosed and form an opening in the top 12. Consequently, the package 26, when installed in the housing 22, would slide below the cutout portion 28 until the opening 30 was in alignment with the cutout portion 28.

The cutout portion 28 can have any suitable shape depending upon the shape of the opening 30 of the package 24. For example, in FIG. 1, the cutout portion 28 is in the shape of a partial oval. Alternatively, the cutout portion 28 can be in the shape of a partial rectangle, a partial circle, or any other suitable shape. If the cutout portion 28, however, has a closed end, then the cutout portion 28 may form a complete oval, a complete rectangle, a complete circle, or the like.

Similar to the top 12, the bottom 14 of the housing 22 can also have a length that is shorter than the length of the package 24. Alternatively, the bottom 14 can have the same length as the package 24 or can be longer than the package 24.

Figure 3:
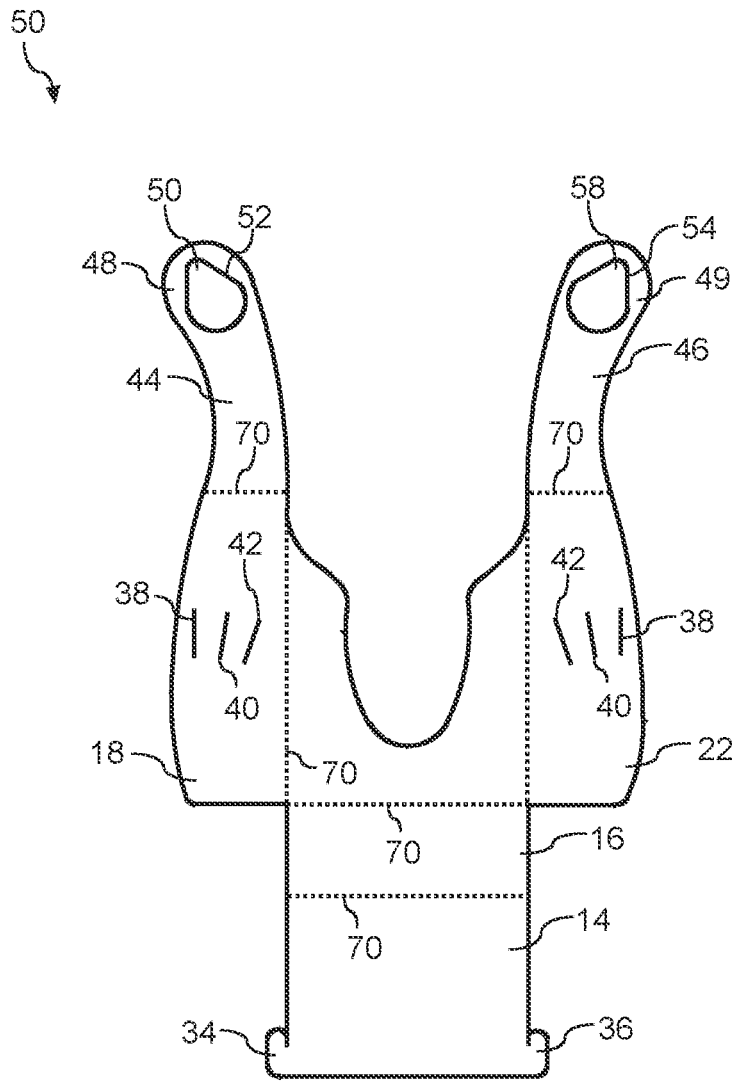
FIG. 3 is a plan view of a one-piece blank that can be used to construct the dispenser as shown in FIG. 1.

In one embodiment, the bottom 14 can include two opposing tabs 34 and 36. The tabs 34 and 36 can be positioned at a terminal end of the bottom 14. For example, as shown in FIG. 3, the dispenser 10 can be made from a single piece blank 50. As shown, the bottom 14 includes a first tab 34 and a second tab 36. The tabs 34 and 36 are configured to engage or be inserted into a corresponding slot located on the side walls 18 and 20 of the housing 22. In one embodiment, the position of the bottom 14 can be adjustable depending upon the size or depth of the package 24.

For example, as shown in FIGS. 1-3, each side wall 18 and 20 can define a plurality of slots, such as slots 38, 40 and 42. As shown in the figures, the slots 38, 40 and 42 can be positioned along the width of each side wall 18 and 20. In the embodiments illustrated, the slots extend along the width in a fan-like configuration. By inserting the corresponding tabs 34 and 36 into a corresponding pair of slots 38, 40 or 42, the depth of the housing 22 can be adjusted. In this manner, the appropriate slot can be selected depending upon the depth of the package 24 inserted into the housing 22. In addition, the depth of the housing 22 can be shortened as the wiping product in the package 24 is depleted. In this way, the opening 30 and the lid 32 of the package stay engaged with the top 12 for facilitating access to the wiping product. For example, adjusting the depth of the housing 22 can keep the lid 32 protruding out and above the exterior surface of the top 12.

As shown in FIGS. 1-3, the dispenser 10 further includes a first arm 44 opposite a second arm 46. The first arm 44 extends from the first side wall 18 while the second arm 46 extends from the second side wall 20. The first and second arms 44 and 46 extend opposite the enclosed first end 16 and away from the housing 22. As shown, the arms 44 and 46 are particularly configured to engage a rolled product fixture 60 that is configured to hold a roll of bath tissue 62. As shown in FIG. 1, the arms 44 and 46 are intended to engage the rolled product fixture 60 without interfering with the ability of the roll of bath tissue 62 to be rotated, dispensed and used. In this regard, in one embodiment, the arms 44 and 46 are spaced apart at least 10.2 cm, such as at least 10.8 cm, such as at least 11.2 cm, such as at least 12 cm apart and are spaced less than about 18 cm, such as less than about 16 cm, such as less than about 14 cm, such as less than about 12 cm apart.

The first arm 44 and the second arm 46 can engage the rolled product fixture 60 using any suitable attachment device. For example, the arms 44 and 46 can be in the shape of hooks or hangers. In the embodiment illustrated in FIGS. 1-3, the arms 44 and 46 include openings 52 and 54 through which a bath roll spindle can be inserted. Referring to FIG. 3, one particular embodiment of a first arm 44 including a first opening 52 and a second arm 46 including a second opening 54 is shown. The first opening 52 is positioned at an end or terminal portion 48 of the first arm 44, while the second opening 54 is positioned at an end or terminal portion 49 of the second arm 46. The openings 52 and 54 can have any suitable shape. For example, the openings can be in the shape of a circle, an oval, a square, a hexagon, or any other suitable shape. The openings 52 and 54 are typically the same shape but can be different shapes. The openings 52 and 54 are aligned in a direction perpendicular to the length direction of the arms 44 and 46.

Referring to FIG. 3, one particular configuration of arms 44 and 46 in combination with openings 52 and 54 is shown. As illustrated, the arms 44 and 46 can be angled in opposite directions away from the housing 22. For example, the arms 44 and 46 can be at an angle to the length direction of the side walls 18 and 22 of greater than about 5°, such as greater than about 8°, such as greater than about 10°, such as greater than about 12°, such as greater than about 14°, such as greater than about 16°, such as greater than about 18°, and generally less than about 60°, such as less than about 40°, such as less than about 30°, such as less than about 25°. In addition, the openings can have a teardrop shape and can define a narrow section or recessed portion. For example, the first opening 52 includes a recessed portion 56 while the second opening 54 can include a recessed portion 58. The recessed portions 56 and 58 are directed towards the end portions 48 and 49 of the arms 44 and 46. In the embodiment illustrated, the recessed portions 56 and 58 also extend at an angle to the length direction of the side walls 18 and 22. Similar to the arms 44 and 46, the recessed portions 56 and 58 are angled away from each other and form an angle with the length direction of the side walls 18 and 22 that is generally greater than about 10°, such as greater than about 15°, such as greater than about 20°, such as greater than about 25°, such as greater than about 30°, such as greater than about 35°, such as greater than about 40°, and generally less than about 70°, such as less than about 60°, such as less than about 50°.

The angles formed by the arms 44 and 46 and by the recessed portions 56 and 58 serve to better present the wiper products as shown in FIG. 1. The above angles, for instance, can keep the dispenser 10 from resting flat against a wall upon which the rolled product fixture 60 is mounted. Instead, the dispenser 10 can angle away from the wall for facilitating access to the wiping product.

In addition, the recesses 56 and 58 are designed to engage rolled product fixtures with different geometries. The recessed portions 56 and 58, for instance, can stabilize the dispenser 10 when engaging a rolled product fixture 60 and keep the dispenser 10 in a more stationary position. The recessed portions 56 and 58, for instance, are well suited for engaging spindles having a circular cross-section as shown in FIG. 1. Some spindles, however, have non-round shapes outside the area where the rolled bath tissue 62 sits. These peripheral areas can have, for instance, a square shape, a circular shape, or an irregular shape. The recessed portions 56 and 58 are well suited to engaging any of these shapes and maintaining the dispenser 10 in an upright configuration as shown in FIG. 1.

As described above and as shown in FIG. 3, the dispenser 10 can be formed from a single piece blank 50. The blank 50 can include various fold lines 70. For example, there can be a fold line 70 between the bottom 14 and the enclosed first end 16 and a fold line 70 between the enclosed first end 16 and the top 12. Fold line 70 can also separate the top 12 from the first and second side walls 18 and 20. In one embodiment, the arms can also be foldable and the blank 50 can include a fold line 70 between the arms 44 and 46 and the side walls 18 and 20. The fold lines 70 can be used to easily assemble the blank 50 into the three-dimensional configuration illustrated in FIG. 1. Simply inserting the tabs 34 and 36 into one of the respective slots 38, 40 or 42 enables assembly of the housing 22.

Figure 4:
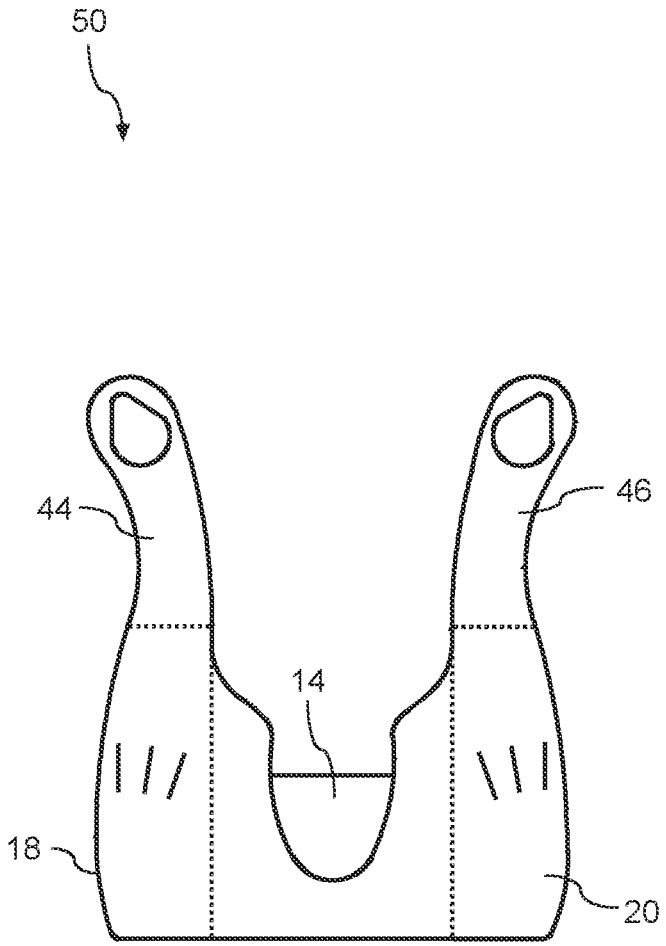
FIG. 4 is a plan view of the blank illustrated in FIG. 3 in a partially folded position.
Figure 5:
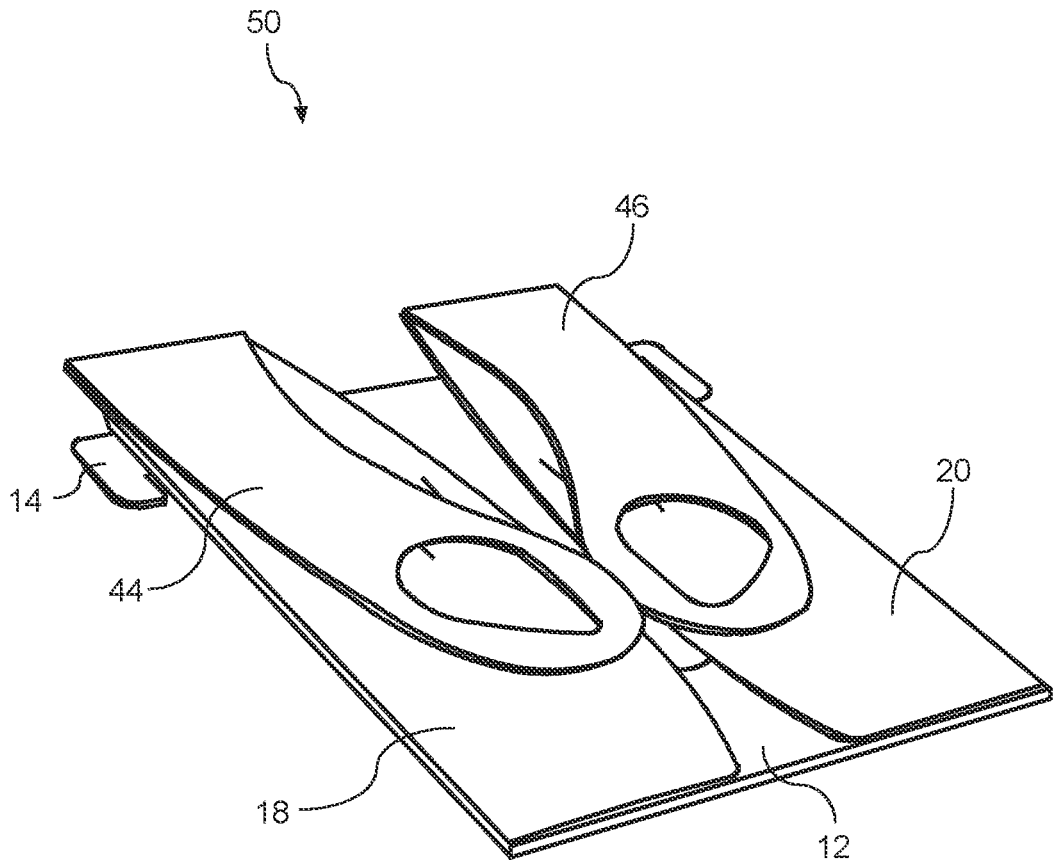
FIG. 5 is a perspective view of the blank illustrated in FIG. 3 in a folded and collapsed configuration.

The blank 50 can also be placed into a compacted folded configuration so that the dispenser 10 can be stored or sold in combination with the package 24. For example, as shown in FIG. 4, in one embodiment, the enclosed first end 16 and the bottom 14 can be folded over onto one surface of the top. As shown in FIG. 5, the side walls 18 and 20 can also be folded onto a surface of the top. The side walls 18 and 20 can be folded onto the top over the bottom 14 and the enclosed first end 16 or can be folded over onto an opposite surface of the top. As shown in FIG. 5, the arms 44 and 46 can be folded over onto the side walls 18 and 20 resulting in the folded configuration as shown in FIG. 5.

Packages for wiping products, such as package 24 in the figures, can have various different dimensions depending upon the particular application and the type of product contained in the package. In one aspect, the package can have a length of from about 16 cm to about 23 cm, a width of from about 8 cm to about 14 cm, and a thickness of from about 1 cm to about 12 cm. The folded blank 50 as shown in FIG. 5 can have dimensions that are very similar to the length and width of the package 24. In this regard, the folded blank 50 can have a length also of from about 16 cm to about 23 cm and a width of from about 8 cm to about 14 cm. Matching the size of the folded blank 50 with the length and width of the package containing the wiping product allows for both components to be easily sold together as a single product, allowing the consumer to assemble the folded blank 50 into the dispenser 10 as shown in FIG. 1.

The wiping product contained within the package 24 for use with the dispenser 10 can vary depending upon the particular application. The wiping product, in one aspect, can be contained in the package as individual sheets. The individual sheets can be stacked on top of each other and can be interfolded. The wiping product can be dry or premoistened.

As used herein, the term a "premoistened wipe" refers to a fibrous sheet that has a liquid applied thereto. The amount of liquid or solution contained within each wet wipe can vary depending upon the type of material being used to provide the wet wipe, the type of liquid being used, and the desired end use of the wet wipe. Generally, each wet wipe can contain from about 25 weight percent to about 600 weight percent or from at least about 70 weight percent to less than about 400 weight percent liquid based on the dry weight of the wipe. To determine the liquid add-on, first the weight of a dry wipe is determined.

The premoistened wipes, for instance, can include a base sheet that is saturated with a cleaning or wiping solution. In general, the base sheet can comprise any suitable porous wiping substrate. Desirably, the base sheet has a soft and pleasing hand and remains resiliently compressible when wet. The base sheet may be made from continuous fibers, stable length fibers, or combinations thereof. In one embodiment, the base sheet is made from renewable resources, is recyclable, and/or is biodegradable. For instance, the base sheet can be made from natural fibers, such as wood pulp fibers, cotton fibers, bamboo fibers, hemp fibers, and the like. The base sheet may contain a minimal amount of synthetic fibers. Alternatively, the base sheet can be made from synthetic fibers that are water soluble or otherwise biodegradable, such as rayon fibers.

The base sheet can comprise a woven, knit or nonwoven fabric. The base sheet may be a single layer base sheet or can comprise a laminate. Suitable base sheets can have a dry basis weight of from about 25 gsm to about 175 gsm.

Particular embodiments of base sheets that may be contained within the package include air-laid nonwoven webs, wet-laid webs, coform webs, hydroentangled webs, and the like.

In general, any suitable wiping or cleaning solution can be impregnated into the base web. In one aspect, the cleaning or wiping solution can also be environmentally friendly. For example, in one embodiment, the solution impregnated into the base web can be water or an aqueous solution. When the wet wipe is for applying to the skin of the user, for instance, the solution can contain water in combination with one or more surfactants. Other additives that can be present in the solution include antiseptics, emollients, skin conditioners, virucides, antibiotics, fragrances, anti-drying agents, and the like.

When used in conjunction with a rolled product fixture 60 as shown in FIG. 1, the premoistened wipes can be water dispersible and/or degradable. In this manner, the premoistened wipes are safe for being flushed down a bathroom commode.

The dispenser 10 and the blank 50 can be made from any suitable material. In one aspect, the material used to make the dispenser 10 and blank 50 is sufficiently semi-rigid or rigid in order for the dispenser to be assembled into the three-dimensional configuration as shown in FIG. 1. In one embodiment, for instance, the dispenser 10 and blank 50 can be made from cellulosic fibers, such as a paperboard material. The paperboard can have a single layer or can have multiple layers. In one aspect, the paperboard can be a cardboard material. If desired, the paperboard material can be coated with a moisture-resistant coating, such as a polymer coating. For example, in one embodiment, various print and designs can be applied to the paperboard material. The paperboard material can then be coated with a transparent polymer material that will protect the material during use.

When the dispenser is made from a paper material, the Gurley stiffness of the package material (as measured by ASTM D6125-97 "Standard Test Method for Bending Resistance of Paper and Paperboard") can be greater than about 10,000 milligrams of force (mgf), such as greater than about 15,000 mgf, such as greater than about 20,000 mgf, such as greater than about 25,000 mgf, and generally less than about 200,000 mgf.

In an alternative embodiment, the dispenser 10 and blank 50 can be made from one or more polymer layers and may contain no cellulosic fibers. For example, the blank 50 and dispenser 10 can be made from a rigid or semi-rigid polymer film that has sufficient plasticity to retain a fold line as shown in FIG. 3. The polymer layer can be made from various different thermoplastic polymers, such as a polyester polymer or a polyolefin polymer. In one aspect, for instance, the blank 50 can be made from a polypropylene polymer.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A dispenser for dispensing sheet materials from a rolled product fixture comprising:

a housing comprising:

a top defining a cutout portion;

a bottom;

an enclosed first end;

first and second opposing side walls positioned between the top and the bottom;

first and second arms, the first arm extending from the first side wall while the second arm extends from the second side wall, each arm being configured to engage a rolled product fixture; and an open second end for receiving a package containing a stack of wiping sheets, wherein the cutout portion of the top is positioned and has a size that corresponds to a dispensing opening on the package loaded into the housing;

wherein the housing is formed from a single blank and the bottom includes a first tab that engages the first side wall and a second tab that engages the second side wall.

2. A dispenser as defined in claim 1, wherein the housing is made from a paperboard that includes a plurality of fold lines.

3. A dispenser as defined in any of claim 1, wherein the housing is made from a polymer that includes a plurality of fold lines, the housing being free of cellulosic fibers.

4. A dispenser as defined in claim 1, wherein the first side wall defines a slot for receiving the first tab and the second side wall defines a slot for receiving the second tab.

5. A dispenser as defined in claim 1, wherein the first side wall defines a plurality of slots that are positioned along a width of the first side wall and wherein the second side wall defines a plurality of slots that are positioned along the width of the second side wall, the slots on the first side wall for receiving the first tab, the slots on the second side wall for receiving the second tab, and wherein a depth of the housing is adjustable by inserting the first and second tabs into one of the corresponding plurality of slots.

6. A dispenser as defined in claim 1, wherein the housing includes an assembled configuration for receiving the package containing the stack of wiping sheets and a folded configuration, wherein the top includes an exterior surface and an interior surface facing an interior volume of the housing, and wherein, when the housing is in the folded configuration, the bottom and the first and second side walls are folded onto one of the surfaces of the top.

7. A dispenser as defined in claim 6, wherein, when the housing is in the folded configuration, the first and second arms are folded onto the first and second side walls.

8. A dispenser as defined in claim 1, wherein the first arm defines a first opening and the second arm defines a second opening and wherein the first and second openings are configured to engage a rolled product fixture.

9. A dispenser as defined in claim 8, wherein the first arm includes a first end portion and the second arm includes a second end portion, the first and second end portions being located on the housing opposite the enclosed first end, the first opening being positioned on the first end portion and the second opening being positioned on the second end portion, wherein the first arm is parallel to the second arm in a length direction and wherein the first opening and the second opening are in alignment in a direction perpendicular to the length direction.

10. A dispenser as defined in claim 1, wherein the first opening and the second opening have a teardrop shape.

11. A dispenser as defined in claim 9, wherein the first opening defines a first recess portion and the second opening defines a second recess portion, the first and second recess portions extending towards a terminal end of each corresponding arm.

12. A dispenser as defined in claim 11, wherein the first and second recess portions extend at an angle to the length direction, the angle being from about 20° to about 50°.

13. A dispenser as defined in claim 1, wherein the top has a length shorter than a length of the first and second side walls, wherein, once a package containing a stack of wiping sheets is loaded into the housing, a portion of the package remains exposed.

14. A dispenser as defined in claim 1, wherein the cutout portion defined by the top has an open end, the cutout portion being configured to only partially surround a dispenser opening on a package loaded into the housing.

15. A dispenser as defined in claim 1, wherein the cutout portion is in a shape of a partial oval or a partial rectangle.

16. A dispenser for dispensing sheet materials from a rolled product fixture comprising:

a housing comprising:

a top defining a cutout portion;

a bottom;

an enclosed first end;

first and second opposing side walls positioned between the top and the bottom;

first and second arms, the first arm extending from the first side wall while the second arm extends from the second side wall, each arm being configured to engage a rolled product fixture; and an open second end; and a package containing a stack of wiping sheets loaded into the open second end of the housing, the package defining a lid that covers a dispenser opening and wherein the cutout portion of the top is positioned and has a size to partially surround the lid and dispenser opening of the package;

wherein the housing is formed from a single blank and the bottom includes a first tab that engages the first side wall and a second tab that engages the second side wall.

17. A dispenser as defined in claim 16, wherein the stack of wiping sheets comprise a stack of premoistened wipers.

18. A dispenser as defined in claim 16, wherein the first arm defines a first opening and the second arm defines a second opening and wherein the first and second openings are configured to engage the rolled product fixture, and wherein the first arm includes a first end portion and the second arm incudes a second end portion, the first and second end portions being located on the housing opposite the enclosed first end, the first opening being positioned on the first end portion and the second opening being positioned on the second end portion, wherein the first arm is parallel to the second arm in a length direction and wherein the first opening and the second opening are in alignment in a direction perpendicular to the length direction, and wherein the first opening defines a first recess portion and the second opening defines a second recess portion, the first and second recess portions extending towards a terminal end of each corresponding arm.

19. A dispenser for dispensing sheet materials from a rolled product fixture comprising:

a housing comprising:

a top defining a cutout portion;

a bottom;

an enclosed first end;

first and second opposing side walls positioned between the top and the bottom;

first and second arms, the first arm extending from the first side wall while the second arm extends from the second side wall, each arm being configured to engage a rolled product fixture;

an open second end for receiving a package containing a stack of wiping sheets, wherein the cutout portion of the top is positioned and has a size that corresponds to a dispensing opening on the package loaded into the housing;

wherein the housing includes an assembled configuration for receiving the package containing the stack of wiping sheets and a folded configuration, wherein the top includes an exterior surface and an interior surface facing an interior volume of the housing, and wherein, when the housing is in the folded configuration, the bottom and the first and second side walls are folded onto one of the surfaces of the top; and wherein when the housing is in the folded configuration, the first and second arms are folded onto the first and second side walls.

20. A dispenser for dispensing sheet materials from a rolled product fixture comprising:

a housing comprising:

a top defining a cutout portion;

a bottom;

an enclosed first end;

first and second opposing side walls positioned between the top and the bottom;

first and second arms, the first arm extending from the first side wall while the second arm extends from the second side wall, each arm being configured to engage a rolled product fixture;

an open second end for receiving a package containing a stack of wiping sheets, wherein the cutout portion of the top is positioned and has a size that corresponds to a dispensing opening on the package loaded into the housing; and wherein the top has a length shorter than a length of the first and second side walls, wherein, once a package containing a stack of wiping sheets is loaded into the housing, a portion of the package remains exposed.

* * * * *